US006313572B1

(12) United States Patent
Yamada

(10) Patent No.: US 6,313,572 B1
(45) Date of Patent: Nov. 6, 2001

(54) ELECTRON EMISSION DEVICE AND PRODUCTION METHOD OF THE SAME

(75) Inventor: Jiro Yamada, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/244,423

(22) Filed: Feb. 4, 1999

(30) Foreign Application Priority Data

Feb. 17, 1998 (JP) ..... 10-034857

(51) Int. Cl.[7] ..... H01J 1/02; H01J 1/16; H01J 19/10; H01J 1/62; H01J 63/04

(52) U.S. Cl. ..... 313/310; 313/309; 313/336; 313/351; 313/495; 313/306; 313/308

(58) Field of Search ..... 313/306–308, 313/309, 310, 311, 336, 351, 495, 496, 497; 315/169.1, 169.3

(56) References Cited

U.S. PATENT DOCUMENTS 5,124,347 6/1992 Connor et al. .
5,192,240 3/1993 Komatsu .
5,281,890 1/1994 Kane .
5,308,439 5/1994 Cronin et al. .
5,378,963 * 1/1995 Ikeda ..... 313/495
5,473,219 * 12/1995 Ikeda ..... 313/497
5,534,743 * 7/1996 Jones et al. ..... 313/309
5,604,399 2/1997 Mandelman et al. .

FOREIGN PATENT DOCUMENTS 0 660 362 A1 6/1995 (EP) .
0 665 571 A1 8/1995 (EP) .

* cited by examiner

*Primary Examiner*—Nimeshkumar D. Patel
*Assistant Examiner*—Mack Haynes
(74) *Attorney, Agent, or Firm*—Ronald P. Kananen; Rader, Fishman & Grauer

(57) ABSTRACT

The present invention provides an electron emission device capable of deflecting emitted electrons to a predetermined direction and preferably emitting electrons with a small drive voltage as well as a production method of the same. The electron emission according to the present invention includes a layered body including an auxiliary electrode, a first insulation layer, a first gate electrode, a second insulation layer, an emitter electrode, a third insulation layer, and a second gate electrode formed in this order on a substrate. In this electron emission device, a hole is formed through the first insulation layer, the first gate electrode, the second insulation layer, the emitter electrode, the third insulation layer, and the second gate electrode, so that the auxiliary electrode is exposed at the bottom of the hole and the first gate electrode protrudes further than the emitter electrode toward the center line of the hole.

5 Claims, 7 Drawing Sheets

ELECTRON EMISSION DEVICE AND PRODUCTION METHOD OF THE SAME

BACKGROUND OF THE INVENTION

1. Field of the Invention

The present invention relates an electron emission device having an electron emitter for emitting electric-field electron emission and a production method of the same and in particular, to an electron emission device having a four-layered configuration of electrodes via an insulation layer and its production method.

2. Description of the Prior Art

These years, development and study on the display apparatus have been directed to reduction in the thickness of the display apparatus. A special attention is paid on electric field emission type display apparatus (hereinafter, referred to as an FED) using so-called electron emission devices.

In this FED, each pixel is constituted by an electron emission device in combination with an anode electrode and a fluorescent body which are opposed to the electron emission device. A plurality of such pixels are formed in a matrix to constitute a display apparatus. In this FED, electrons emitted from the electron emission device are accelerated by the electric field between the electron emission device and the anode electrode to attack the fluorescent body. Thus, the fluorescent body is excited to emit light, so as to display an image.

Generally, this electron emission device may be of a spint type or a planar type. The spint type of electron emission device includes an emitter electrode of an approximately conical shape, to which a predetermined electric field is applied so as to emit electrons. Moreover, when producing this spint type of electron emission device, a hole having a diameter of about 1 micrometer is formed and inside this hole, the emitter electrode is formed by way of deposition or the like.

However, in such a spint type of electron emission device, it is difficult to form the aforementioned conical emitter electrode with a desired configuration, disabling to obtain a stable electron emission characteristic. In particular, when producing a large-screen FED, it is necessary to uniformly form the emitter electrodes over a large substrate. In other words, unless the emitter electrodes are formed uniformly, the field electron emission characteristic varies depending on a position on the screen, disabling display of a preferable image.

On the other hand, the planar type electron emission device includes an emitter electrode formed in a flat sheet shape sandwiched via an insulation layer by a pair of gate electrodes, so that an electric field generated between the pair of gate electrodes and the emitter electrode causes the emitter electrode to emit electrons.

In this planar type electron emission device, the emitter electrode for emitting electrons can be formed approximately in a flat sheet shape. Accordingly, this type of electron emission device can be produced easier than the aforementioned spint type electron emission device.

In the planar type electron emission device having the aforementioned configuration, electrons emitted from the emitter electrode are accelerated to attack the fluorescent body in the same way as in the spint type electron emission device. Thus, in the FED using this planar type electron emission device, the fluorescent body is excited to emit light, so as to display an image.

The aforementioned planar type electron emission device is disclosed in U.S. Pat. No. 5,308,439, U.S. Pat. No. 5,604,399, U.S. Pat. No. 5,192,240, Japanese Patent Publication (Unexamined) 2-133397, and Japanese Patent Publication (Unexamined) 7-254354. In the electron emission devices disclosed in these documents, it is difficult to deflect to a desired direction the electrons emitted from the emitter electrode, disabling use of the device in a FED.

In order to solve this problem, as a planar type electron emission device, U.S. Pat. No. 5,124,347 discloses a four-layered electron emission device. In this four-layered electron emission device, a through hole is formed through the pair of electrodes sandwiching the emitter electrode via an insulation layer and an auxiliary electrode is arranged at the bottom of the hole.

In the four-layered electron emission device having the aforementioned configuration, the auxiliary electrode generates an electric field which deflects the electrons emitted from the emitter electrode, to the direction of the anode electrode. Thus, the four-layered electron emission device can effectively make the electrons emitted from the emitter electrode, to attack the fluorescent body on the anode electrode, enabling a display of a comparatively preferable image.

In the aforementioned four-layered electron emission device, the electrons are deflected by the electric field generated by the auxiliary electrode, which may also affect the emitter electrode. That is, in this electron emission device, the electric field generated from the auxiliary electrode affects the vicinity of the tip end of the emitter electrode.

Moreover, the emitter electrode is subjected to an electric field for emitting electrons from the pair of gate electrodes. However, in the conventional four-layered electron emission device, as has been described above, the electric field generated from the auxiliary electrode is applied to the emitter electrode and accordingly, the electric field applied from the pair of gate electrodes to the emitter electrode becomes relatively small.

For this, in the four-layered electron emission device, there is a problem that the electron quantity emitted from the emitter electrode is reduced. In order to compensate this reduction in the electron emission quantity, it is necessary to increase the drive voltage applied to the pair of gate electrodes. In this case, in the electron emission device, it is necessary to increase the voltage resistance of the drive circuit, which significantly increases the production cost.

SUMMARY OF THE INVENTION

It is therefore an object of the present invention to provide an electron emission device capable of deflecting emitted electrons into a predetermined direction and preferably emitting electrons with a small drive voltage, as well as a production method of the same.

The electron emission device according to the present invention includes: an auxiliary electrode layered over a substrate; a first gate electrode layered via a first insulation layer over the auxiliary electrode; an emitter electrode layered via a second insulation layer over the first gate electrode for emitting electrons when subjected to an electric field; and a second gate electrode layered via a third insulation layer over the emitter electrode; wherein a hole is formed through the first insulation layer, the first gate electrode, the second insulation layer, the emitter electrode, the third insulation layer, and the second gate electrode, so that the auxiliary electrode is exposed at a bottom of the hole; and the first gate is formed so as to protrude further than the emitter electrode toward a center line of the hole.

In the electron emission device having the aforementioned configuration, a predetermined voltage is applied to the first gate electrode and the second gate electrode so as to apply a predetermined electric field to the emitter electrode. Thus, the emitter electrode emits electrons.

Moreover, in this electron emission device, a predetermined voltage is applied to the auxiliary electrode so that the auxiliary electrode generates a predetermined electric field, which is used to deflect electrons emitted from the emitter electrode.

Furthermore, in this electron emission device, the first gate electrode has an opening end protruding further than the emitter electrode toward the center line of the hole. Accordingly, in this electron emission device, the electric field generated by the auxiliary electrode is shaded by the first gate electrode, suppressing the effect to the emitter electrode. Thus, in this electron device, the electric field generated from the first gate electrode and the second gate electrode is effectively applied to the emitter electrode.

On the other hand, the electron emission device production method according to the present invention includes steps of: forming a layered body by forming on a substrate a first insulation layer, a first gate electrode, a second insulation layer, an emitter electrode, a third insulation layer, and a second gate electrode in this order; carrying out anisotropic etching on the layered body to form a first hole so as to expose the first gate electrode; forming a sacrifice layer to cover a surface of the layered body and an inner wall of the first hole as well as a predetermined area at an outer circumference of the first gate electrode; and carrying out etching on the first gate electrode exposed outwardly and the first insulation layer so as to form a second hole; wherein the second hole is formed to have a smaller opening dimension than the first hole.

In the electron emission production method having the aforementioned configuration, after the first hole is formed, the sacrifice layer is formed. This sacrifice layer is formed so as to cover the inner wall of the first hole together with the outer circumference of the first gate electrode exposed to the bottom of the first hole. In this state, etching is carried out to the exposed first gate electrode, enabling forming the second hole having a smaller opening dimension than the first hole.

DETAILED DESCRIPTION OF PREFERRED EMBODIMENTS

Hereinafter, description will be directed to preferred embodiments of the present invention with reference to the attached drawings.

Figure 1:
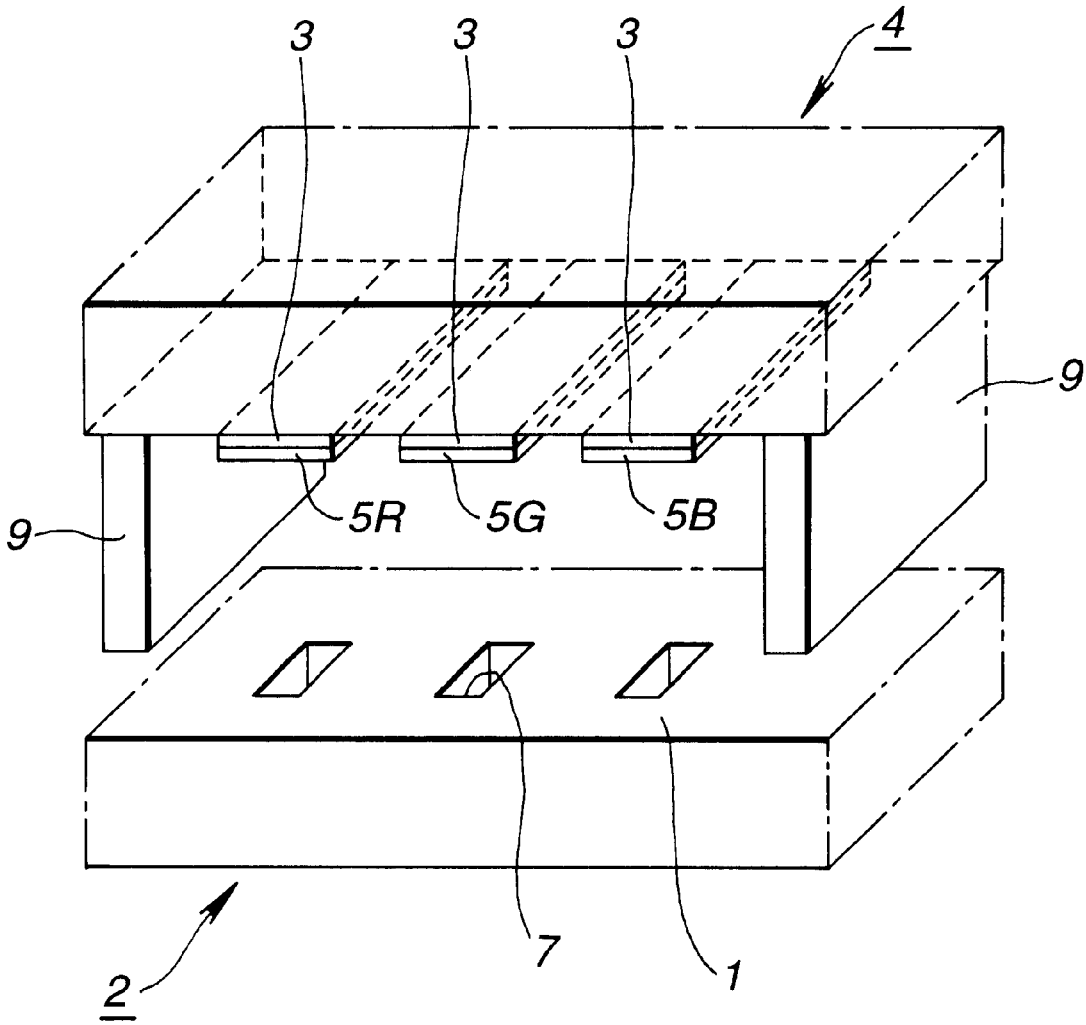
FIG. 1 is a perspective view schematically showing a configuration of an FED using an electron emission device according to the present invention.

As shown schematically in FIG. 1, the electron emission device according to the present embodiment is applied to a so-called field emission display (FED). This FED includes a back plate 2 on which the electron emission device 1 is formed for carrying out field electron emission; and a face plate 4 on which an anode electrode 3 is formed in stripes. In this FED, a high vacuum state is maintained between the back plate 2 and the face plate 4.

In this FED, on the face plate 4, a red fluorescent body 5R for emitting a red light is formed on a predetermined anode electrode 3; a green fluorescent body 5G is for emitting a green light is formed on the adjacent anode electrode 3; and a blue fluorescent body 5B for emitting a blue light is formed on the further adjacent anode 3. That is, on this face plate, a plurality of red fluorescent bodies 5R, a plurality of green fluorescent bodies 5G, and a plurality blue fluorescent bodies 5B (hereinafter, referred to as fluorescent bodies 5) are arranged alternately in stripes.

Figure 2:
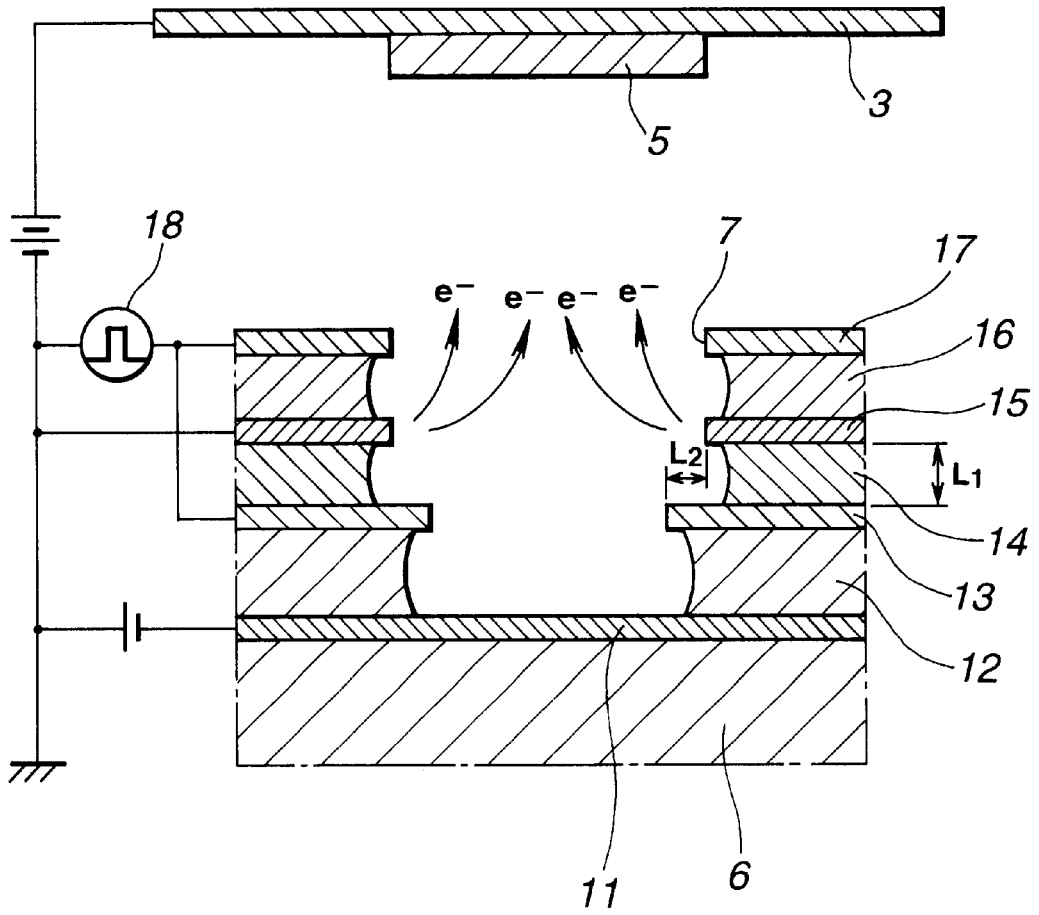
FIG. 2 is a cross sectional view for explanation of an entire configuration and a drive circuit of the electron emission device.

Moreover, in this FED, as shown in FIG. 1 and FIG. 2, a plurality of the electron emission devices 1 are formed in a matrix on the insulation substrate 6. Each of the electron emission devices 1, as will be detailed later, has a predetermined layered configuration and has a hole 7 formed in a layering direction for emitting electrons.

The hole 7, i.e., the opening of each of the electron emission devices 1, is arranged at a position facing the red fluorescent body 5R, the green fluorescent body 5B, and the blue fluorescent body 5B.

In this FED, a pixel is constituted by a predetermined region of the red fluorescent body 5R, the green fluorescent body 5G, and the blue fluorescent body 5B directly facing the electron emission device 1. It should be noted that in this FED, it is possible to arrange a plurality of electron emission devices 1 to face a fluorescent body 5 constituting a pixel.

Furthermore, in this FED, there are provided a plurality of pillars 9 arranged between the back plate 2 and the face plate 4. The pillars 9 maintain a predetermined distance between the back plate 2 and the face plate 4 in a high vacuum.

This electron emission device 1, as shown in FIG. 2, includes: an insulation substrate 6 made from glass or the like; an auxiliary electrode 11 formed on the insulation substrate 6; a first gate electrode 13 layered via a first insulation layer 12 on the auxiliary electrode 11; an emitter electrode 15 layered via a second insulation layer 14 on the first gate electrode 13; and a second gate electrode 17 layered via a third insulation layer 16 on the emitter electrode 15.

Moreover, in this electron emission device 1, a hole 7 is formed through the first insulation layer 12, the first gate electrode 13, the second insulation layer 14, the emitter electrode, the third insulation layer 16, and the second gate electrode 17 so that the auxiliary electrode 11 is exposed at the bottom of the hole 7. Furthermore, in this electron emission device 1, the first gate electrode 13 is formed so as to protrude into the hole further than the opening end of the emitter electrode 15. In this electron emission device 1, the hole 7 is formed so as to have an approximately rectangular opening. However, the configuration of this hole 7 is not to be limited to the rectangular shape but may be circular, elliptical, or polygonal unless an acute angle is contained.

Furthermore, as shown in FIG. 2, in this electron emission device 1, grounding potential is applied to the emitter electrode 15; a signal potential of 0 to 100 V is applied to the first and the second gate electrodes 17 via a pulse oscillator 18; and a constant potential of −50 to 50 V is applied to the auxiliary electrode 11.

In this electron emission device 1, the auxiliary electrode 11, the first gate electrode 13, the emitter electrode 15, and the second gate electrode 17 are formed from a conductive material such as Ti, Cr, Mo, W, and the like with a film thickness of about 0.1 micrometer. Moreover, the first insulation layer 12, the second insulation layer 14, and the third insulation layer 16 are formed from an insulation material such as $SiO_2$.

In this electron emission device 1, the first insulation layer 12, the second insulation layer 14, and the third insulation layer 15 are formed so as to be recessed from the opening defined by the first gate electrode 13, the emitter electrode 15, and the second gate electrode 17. That is, in this electron emission device 1, the first gate electrode 13, the emitter electrode 15, and the second gate electrode 17 are formed to protrude from the first insulation layer 12, the second insulation layer 14, and the third insulation layer 16.

Moreover, in this electron emission device 1, as shown in FIG. 2, if it is assumed that L1 is the film thickness of the second insulation layer 14, and that L2 is the protrusion amount of the first gate electrode 13 with respect to the emitter electrode 15, it is preferable that the following relationship be satisfied.

$$0.5 \leqq L2/L1 \leqq 2.0 \quad \text{(Expression)}$$

The electron emission device 1 having the aforementioned configuration has a plurality of holes 7 arranged in a matrix and these holes 7 are successively driven to successively emit electrons. Thus, the electron emission device 1 successively makes the fluorescent bodies 5 to emit light to display an image on the face plate 4.

Here, in the electron emission device 1, a predetermined voltage is applied to the first gate electrode 11 and the second gate electrode 17 according to a pulse signal corresponding to an image signal. This drives predetermined holes 7 among the plurality of holes 7 arranged in a matrix.

Moreover, by applying a predetermined voltage to the first gate electrode 11 and the second gate electrode 17, an electric field is generated between the first gate electrode 11, the second gate electrode 17, and the emitter electrode 15. This electric field is applied to the emitter electrode 15 so that the emitter electrode 15 emits electrons from its tip end by way of so-called field electron emission.

Here, in the electron emission device 1, a predetermined negative voltage is applied to the auxiliary electrode 11, which generates a predetermined electric field from the auxiliary electrode 11. This electric field is generated almost in a vertical direction to the plane of the auxiliary electrode 11, i.e., in the direction of the anode electrode 5.

Accordingly, in the electron emission device 1, as has been described above, electrons emitted from the emitter electrode 15 are deflected into the direction of the anode electrode 3, i.e., in a direction vertical to the insulation substrate 6. Especially in this electron emission device 1, even electrons emitted almost parallel to the insulation substrate 6 are also deflected into a direction vertical to the insulation substrate 6.

Consequently, in this electron emission device, it is possible to make the electrons from the emitter electrode 15 effectively attack the fluorescent body 5 formed on the anode electrode 3. Thus, this electron emission device 1 can effectively make the fluorescent body 5 emit light, enabling a significantly increased FED luminance.

Moreover, in this electron emission device 1, the first gate electrode 13 was formed to protrude further than the emitter electrode 15 and accordingly, a part of the electric field generated from the auxiliary electrode 13 is shaded by the first gate electrode 11. Consequently, the electric field generated from the pair of gate electrodes 13 and 17 can effectively be applied to the emitter electrode 15. In other words, in this electron emission device 1, the electric field applied to the emitter electrode 15 will not be weakened by the electric field generated from the auxiliary electrode 11. Accordingly, in this electron emission device 1, in order to obtain a desired electron emission quantity, there is no need of consideration on an affect from the electric field generated from the auxiliary electrode 11. It is possible to obtain a desired electron emission quantity by applying a comparatively small drive voltage to the first gae electrode 13 and the second gate electrode 17.

In this electron emission device 1, as has been described above, a predetermined electric field is formed between the back plate 2 and the anode electrode 3. This electric field accelerates electrons in a direction to the anode electrode 3. Here, in the electron emission device 1, the electrons deflected to be concentrated around the center line of the hole 7 are accelerated to attack the fluorescent body 5 formed on the anode electrode 3. Accordingly, in this electron emission device 1, the emitted electrons can be concentrated to attack the narrow range of the fluorescent body 5. In other words, in this electron emission device 1, electrons can be focused into a predetermined direction and accordingly, it is possible to make small the width of the fluorescent body 5. For this, the electron emission device 1 can be preferably applied to an FED having fine fluorescent bodies 5.

Figure 3:
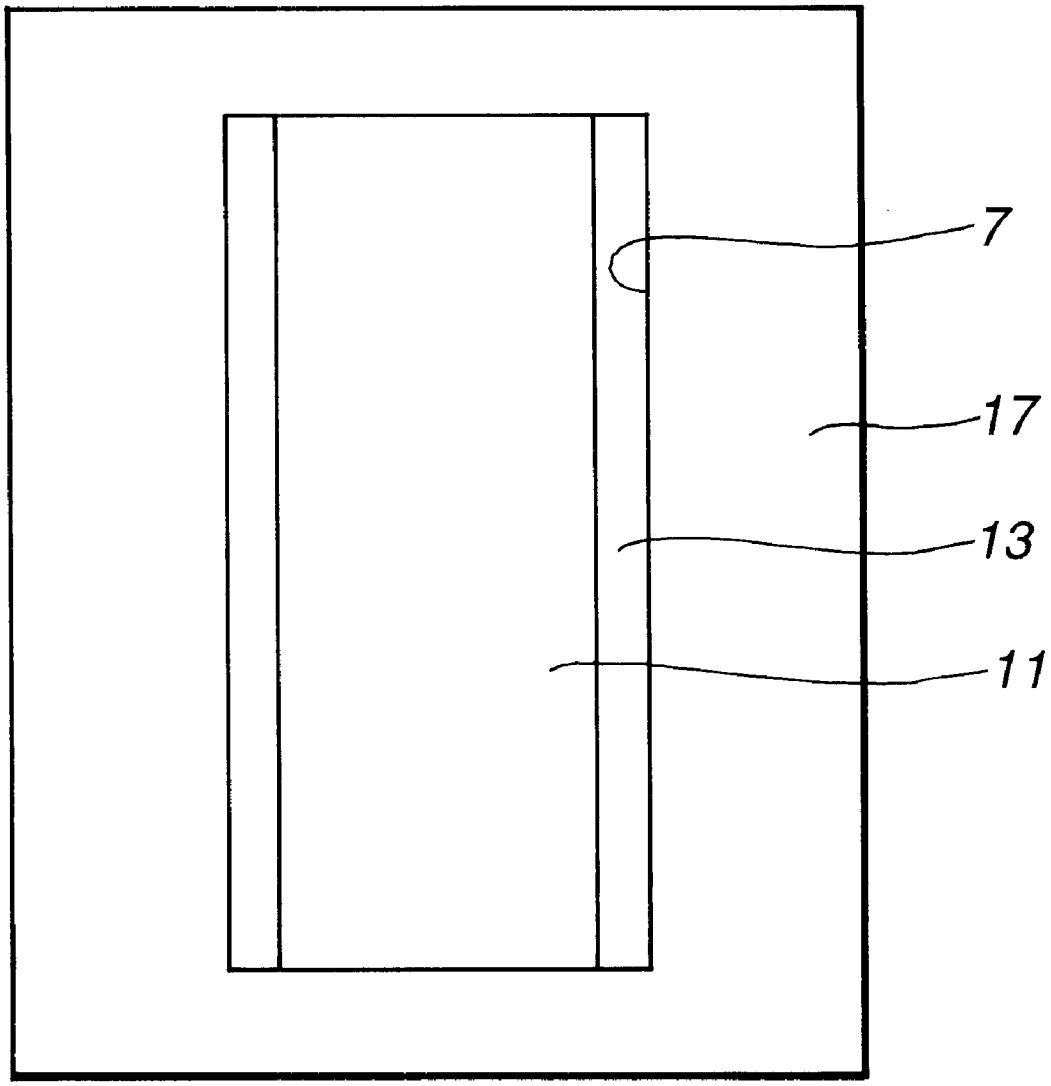
FIG. 3 is a plan view showing an essential portion of an opening of the electron emission device.

More specifically, in this electron emission device 1, as shown in FIG. 3, the hole 7 preferably has an opening where the first gate electrode 13 formed in the longitudinal direction protrudes from the emitter electrode 15.

Thus, in this electron emission device 1, it is possible to obtain focus in a direction vertically intersecting the longitudinal direction of the opening of the hole 7. Accordingly, in this electron emission device 1, it is possible to assure electron attack to the opening fluorescent body 5 without attacking a fluorescent body 5 adjacent to the opposing, fluorescent body 5. Consequently, in the FED using this electron emission device 1, it is possible to obtain an accurate color display without causing color disorder.

Figure 4:
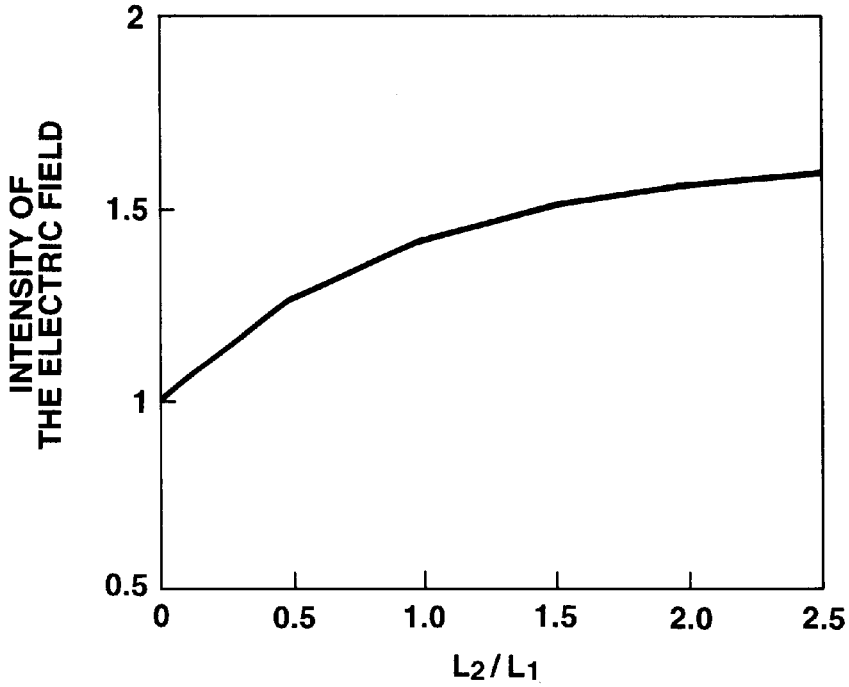
FIG. 4 shows a relationship between a value of L2/L1 and the intensity of electric field applied to a tip end of an emitter electrode.

Furthermore, FIG. 4 shows a relationship between the intensity of the electric field applied to the emitter electrode 15 and the ratio of the film thickness L1 of the second insulation layer 14 with the protrusion amount L2 of the first gate electrode 13 in this electron emission device 1. It should be noted that in this FIG. 4, the vertical axis represents the intensity of the electric field applied to the emitter electrode 15 and the horizontal axis represents the relation of L1 with L2, i.e., L2/L1.

As is clear from this FIG. 4, while the value of L2/L1 is positive, it is possible to increase the intensity of the electric field applied to the emitter electrode 15. Accordingly, in this electron emission device 1, by the protrusion of the first gate electrode 13, it is possible to increase the electron quantity emitted from the emitter electrode 15. Here, by setting the value of L2/L1 in the range of the aforementioned expression, it is possible to further increase the electron quantity emitted from the emitter electrode 15. Here, if the value of L2/L1 is smaller than 0.5, it is impossible to increase by 1.25 times or more the intensity of the electric field applied to the emitter electrode 15. Moreover, even if the value of L2/L1 is increased by 2.0 or more, the intensity of the electric field applied to the emitter electrode 15 stays unchanged like when the value of L2/L1 is about 2.0.

The electron emission device production method according to the present invention is applied when producing the aforementioned electron emission device.

Figure 5:
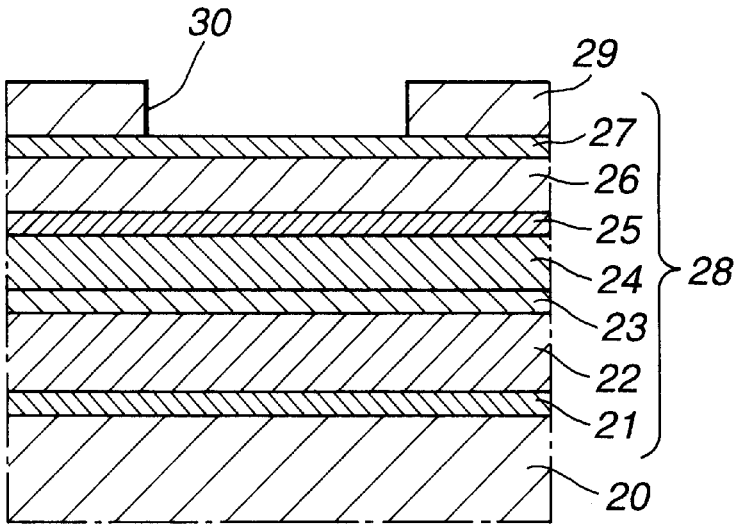
FIG. 5 shows an electron emission device production method according to the present invention at a stage where a layered body and a photo-resist have been formed on the insulating substrate.

In this method, firstly, as shown in FIG. 5, on an insulation substrate 20 made from glass or the like, following layers are successively formed: a first conductive layer 21, a first insulation layer 22, a second conductive layer 23, a second insulation layer 24, a third conductive layer 25, a third insulation layer 26, and a fourth conductive layer 27 in this order, thus forming the layered body 28. On this layered body 28, a photo-resist 29 is formed with a predetermined configuration.

More specifically, the first insulation layer 22, the second insulation layer 24, and the third insulation layer 26 are made from a insulation material such as $SiO_2$ by way of sputter deposition or plasma CVD using $SiH_4$ and $N_2O$ gases. Here, the first insulation layer 22 is formed with a film thickness of about 0.5 micrometers, the second insulation layer 24 with a film thickness of about 0.2 micrometers, and the third insulation layer 26 with a film thickness of about 0.2 micrometers. Furthermore, the first conductive layer 21, the second conductive layer 23, the third conductive layer 25, and the fourth conductive layer 27 are formed from a conductive material such as Ti, Cr, Mo, W or the like by way of sputter deposition or electron beam (EB) deposition. Here, each of the first conductive layer 21, the second conductive layer 23, the third conductive layer 25, and the fourth conductive layer is formed with a film thickness of about 0.1 micrometer.

Moreover, the photo-resist 29 has a configuration having an opening 30 arranged in a matrix. This photo-resist 29 is formed by applying a photo-resist material over the fourth conductive layer 27 which is patterned as has been described above by way of photo-lithography, etching, and the like.

Figure 6:
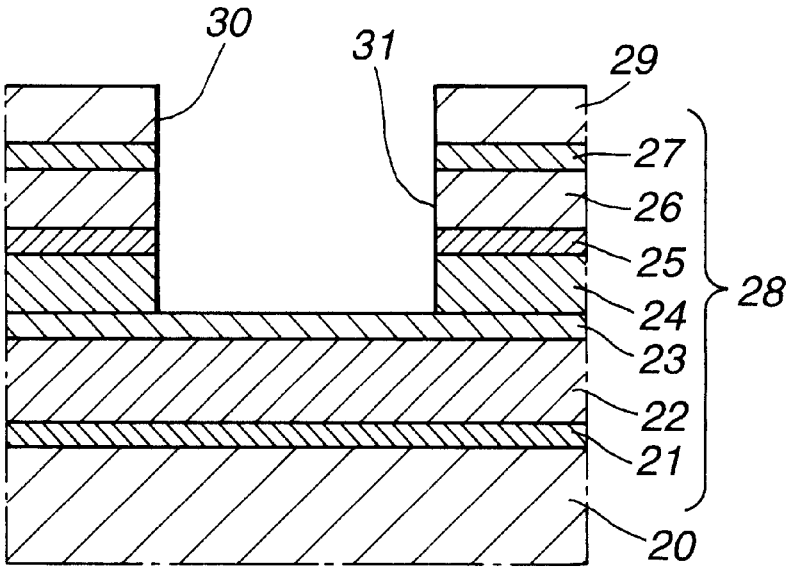
FIG. 6 shows the electron emission device production method according to the present invention at a stage where a first opening has been formed.

Next, as shown in FIG. 6, anisotropic etching is carried out to the surface where the photo-resist is formed until the second conductive layer 23 is exposed. Thus, the etching is carried out almost in a vertical direction from the opening 30 of the photo-resist 29, thus forming a first opening 31. For example, to the fourth conductive layer 27 and the third conductive layer 25, this anisotropic etching may be a reaction type ion etching using $SF_6$. The third insulation layer 26 and the second insulation layer 24 may be subjected to a reaction type ion etching using $CHF_3$ gas or the like.

Figure 7:
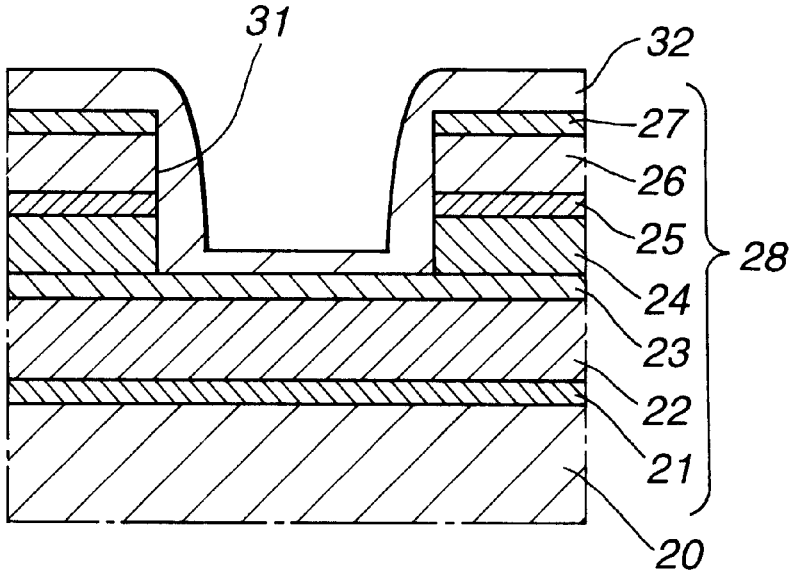
FIG. 7 shows the electron emission device production method according to the present invention at a stage where a sacrifice layer has been formed.

Next, the photo-resist 29 is removed and as shown in FIG. 7, a sacrifice layer 32 is formed on the plane where the second conductive layer 23 is exposed. This sacrifice layer 32, for example, is formed from amorphous silicon or $SiO_2$ by way of plasma CVD. Here, the sacrifice layer 32 is formed on the fourth conductive layer 27, on the side wall of the aforementioned first opening 31, and on the second conductive layer 23 exposed to the bottom of the first opening 31. It should be noted that the sacrifice layer 32 formed on the second conductive layer 23 is formed with a smaller thickness than the sacrifice layer 32 formed on the fourth conductive layer 27.

Figure 8:
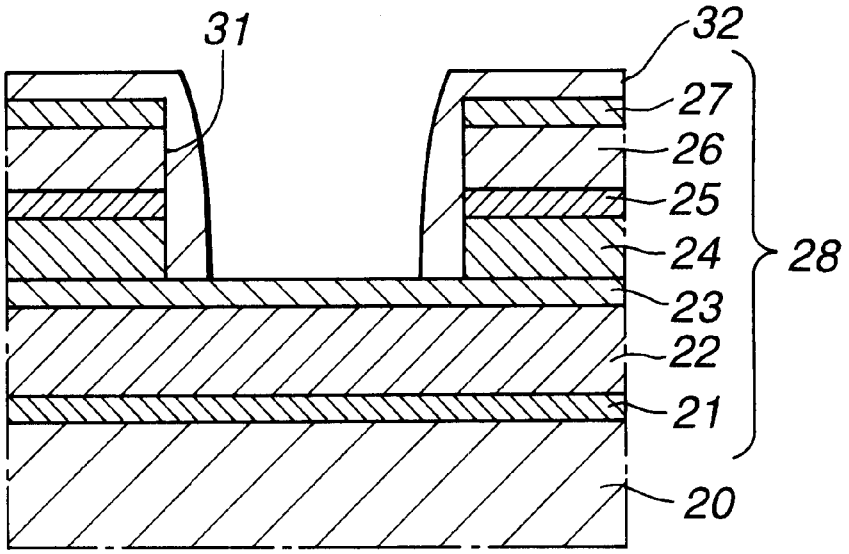
FIG. 8 shows the electron emission device production method according to the present invention at a stage where a part of the sacrifice layer has been removed.

Next, as shown in FIG. 8, etching is carried out to remove a part of the sacrifice layer 32 formed on the second conductive layer 23. Here, the etching may be anisotropic etching such as a reaction type ion etching using $SF_6$ gas or the like if the sacrifice layer 32 is made from amorphous silicon. Thus, in this processing step, the anisotropic etching enables removing a part of the sacrifice layer 32 formed on the second conductive layer 23 while leaving the sacrifice layer 32 formed on the side wall of the opening 31. As a result, the second conductive layer is exposed at the center of the bottom of the first opening 31, while the side wall of the first opening 31 is covered with the sacrifice layer 31.

Figure 9:
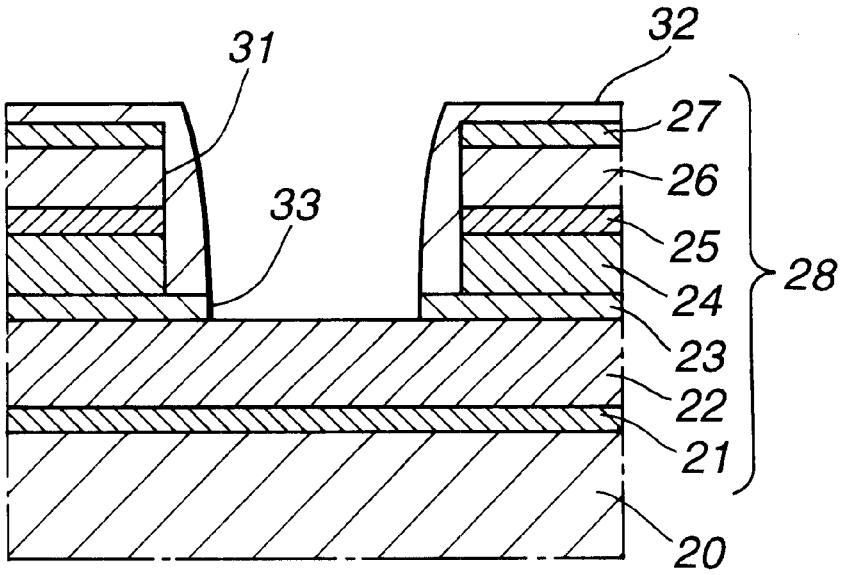
FIG. 9 shows the electron emission device production method according to the present invention at a stage where a second opening has been formed.

Next, as shown in FIG. 9, anisotropic etching is carried out using the sacrifice layer 32 as a mask to remove the second conductive layer 23 exposed. In this anisotropic etching, the aforementioned reaction type ion etching is carried out to the exposed second conductive layer 23 to form a second opening, 33. Thus, the exposed portion of the conductive layer 23 constituting the bottom of the first opening 31 is removed, while leaving the portion covered with the side wall of the first opening 23.

Figure 10:
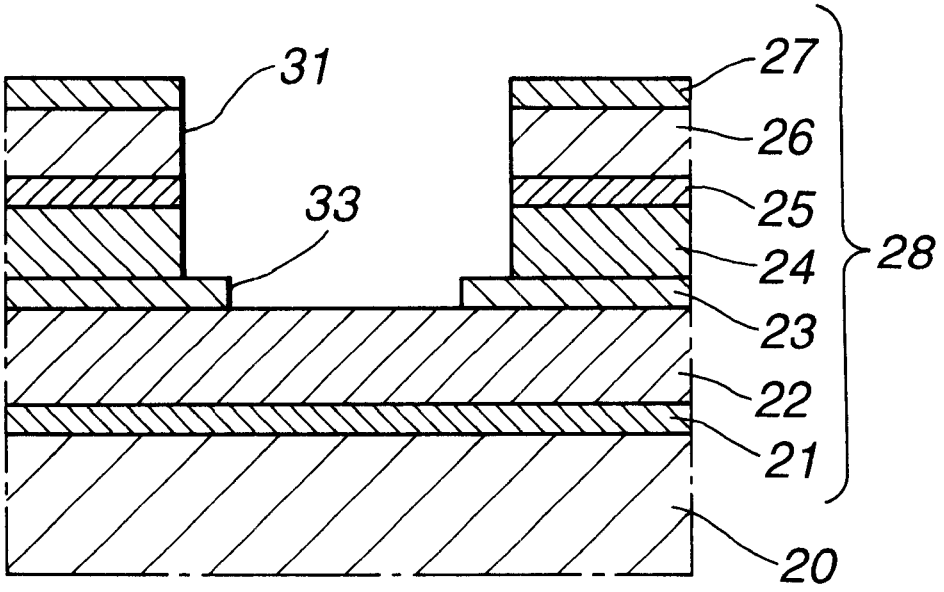
FIG. 10 shows the electron emission device production method according to the present invention at a stage where the sacrifice layer has been removed.

Next, as shown in FIG. 10, the sacrifice layer 32 is removed by way of wet etching using a KOH aqueous solution or the like. This etching leaves the first opening 31 exposed as a hole through the second insulation layer 24, the third conductive layer 25, the third insulation layer 26, and the fourth conductive layer 27, and a second opening 33 as a hole through the second conductive layer 23. By this method, the second opening 33 can have a smaller opening dimension than the first opening 31.

Figure 11:
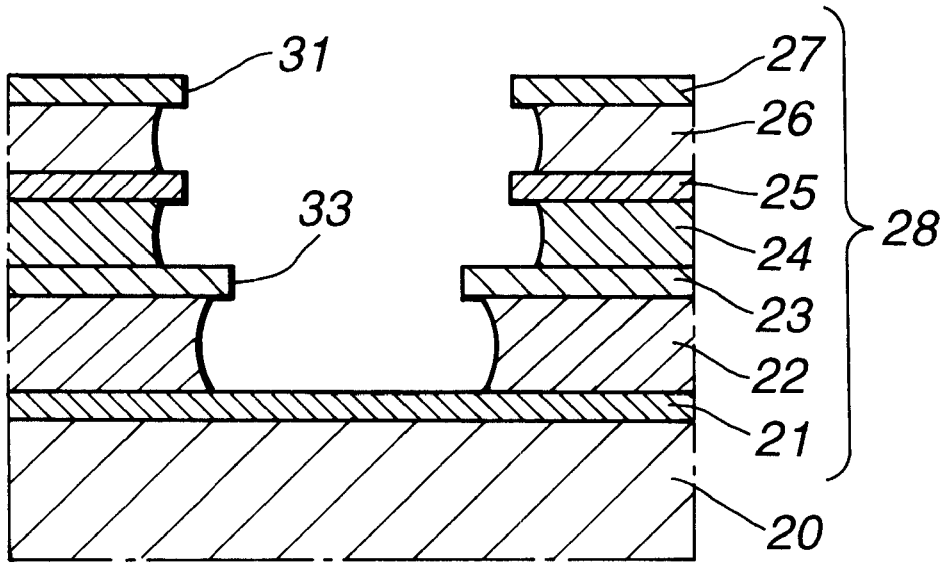
FIG. 11 shows the electron emission device production method according to the present invention at a stage where isotropic etching has been carried out.

Next, as shown in FIG. 11, isotropic etching is carried out until the first conductive layer 21 is exposed. This isotropic etching may be, for example, wet etching using buffered fluoride. This isotropic etching isotropically etches the first insulation layer 22 as well as the second insulation layer 24 and the third insulation layer 26. Here, the first insulation layer 22 is etched to have an opening end recessed from the opening end of the second conductive layer 23. Similarly, the second insulation layer 26 and the third insulation layer 26 are etched so as to have their opening ends recessed from the opening end of the third conductive layer 25 and the fourth conductive layer 27, respectively.

Thus, in this method, the first conductive layer 21 is made to serve as the auxiliary electrode 11, the second conductive layer 23 and the fourth conductive layer 27 serve as the first gate electrode 13 and the second gate electrode 17, respectively, and the third conductive layer 25 serves as the emitter electrode 15. According to this method, it is possible to form the second gate electrode 17 to protrude toward the center line of the hole 7 further than the emitter electrode 15.

Moreover, in this method, the second conductive layer 23 constituting the bottom of the first opening 31 and covered by the sacrifice layer 32 formed on the side wall of the first opening 31 becomes the protrusion amount of the first gate electrode 13. Accordingly, in this method, by adjusting the thickness of the sacrifice layer 32 formed on the side wall of the first opening, it is possible to control the protrusion amount of the first gate electrode 13 with respect to the emitter electrode 15. Consequently, this method facilitates to control the protrusion amount of the first gate electrode 13.

As has been described above, in the electron emission device according to the present invention, the first gate electrode is formed to protrude inside the hole further than the emitter electrode. Accordingly, the electric field generated by the auxiliary electrode is shaded by the first gate and not applied to the emitter electrode. Thus, in this electron emission device, the electric field generated from the first gate electrode and the second gate electrode is effectively applied to the emitter electrode. Consequently, in this electron emission device, it is possible to use the electric field generated from the auxiliary electrode to deflect electrons to a desired direction as well as to apply a large electric field to the emitter electrode without applying a large voltage to the first and the second gate electrodes, thus enabling an improvement to the electron emission characteristic.

Moreover, in the electron emission device production method according to the present invention, a sacrifice layer is used so that the second hole has a smaller opening dimension than the first hole. Accordingly, in this method, it is possible to easily produce an electron emission device in which an electric field generated from the auxiliary electrode is used to deflect electrons to a desired direction as well as to apply a large electric field to the emitter electrode without applying a large voltage to the first and the second gate electrodes, thus enabling to improve the electron emission characteristic.

What is claimed is:

1. An electron emission device comprising:

an auxiliary electrode layered over a substrate;

a first gate electrode layered via a first insulation layer over said auxiliary electrode;

an emitter electrode layered via a second insulation layer over said first gate electrode for emitting electrons when subjected to an electric field;

a second gate layered via a third insulation layer over said emitter electrode;

wherein a hole is formed through said first insulation layer, said first gate electrode, said second insulation layer, said emitter electrode, said third insulation layer, and said second gate electrode, so that said auxiliary electrode is exposed at a bottom of said hole;

said first gate electrode is protruding further than said emitter electrode toward a center line of said hole;

said first insulation layer having an opening end recessed further than an opening end of said first gate electrode;

said second insulation layer and said third insulation layer having opening ends recessed further than opening ends of said emitter electrode and said second gate electrode;

wherein if L1 is the film thickness of said second insulation layer and L2 is the protrusion amount of said first gate electrode, then L1 and L2 satisfy the relationship:

$$0.5 \leqq L2/L1 \leqq 2.0.$$

2. An electron emission device comprising:

an auxiliary electrode layered over a substrate;

a first gate electrode layered over a first insulation layer, layered, in turn, over said auxiliary electrode;

an emitter electrode for emitting electrons when subjected to an electric field, layered over a second insulation layer, layered, in turn, over said first gate electrode;

a second gate electrode layered over a third insulation layer, layered, in turn, over said emitter electrode;

a hole with an effective center formed through said first insulation layer, said first gate electrode, said second insulation layer, said emitter electrode, said third insulation layer, and said second gate electrode, said hole exposing said auxiliary electrode at said hole's bottom;

said first gate protruding further into said hole, toward its effective center, than a protrusion of said emitter electrode;

said first insulation layer having an opening end facing said hole that is recessed further from said effective center than an opening end, facing said hole, of said first gate electrode;

said second insulation layer and said third insulation layer having opening ends facing said hole that are recessed further from said effective center than the opening ends of said emitter electrode and said second gate electrode facing said hole; and, where L1 is the thickness of said second insulation layer and L2 is the difference between the protrusion of said first gate electrode and said emitter electrode, the relationship between L1 and L2 is that 2.0 is equal to or greater than L2/L1 which is, in turn, equal to or greater than 0.5.

3. An electron emission device comprising:

a plurality of planar layers including a plurality of conducting layers and a plurality of non-conducting layers, alternating with respect to each other;

one of said conducting layers being an emitter electrode and another being a gate electrode, said emitter electrode and said gate electrode being separated by one of said non-conducting layers, where L1 is the thickness of said layer separating said emitter electrode and said gate electrode;

a hole formed through said layers that is generally perpendicular to said layers;

said gate electrode and said emitter electrode protruding into said hole, said protrusion of said gate electrode being greater than the protrusion of said emitter electrode, L2 being the difference between the protrusion of said gate electrode and said emitter electrode, the relationship between L1 and L2 is that 2.0 is equal to or greater than L2/L1 which is, in turn, equal to or greater than 0.5.

4. An electron emission device production method comprising steps of:

forming a layered body by forming on a substrate a first insulation layer, a first gate electrode, a second insulation layer, an emitter electrode, a third insulation layer, and a second gate electrode in this order, carrying out anisotropic etching to said layered body to form a first hole so as to expose said first gate electrode;

forming a sacrifice layer to cover a surface of said layered body and an inner wall of said first hole as well as a predetermined area at an outer circumference of said first gate electrode, carrying out etching to said first gate electrode exposed outward and said first insulation so as to form a second hole, said second hole being formed to have a smaller opening dimension than said first hole;

wherein if L1 is the film thickness of said second insulating layer and L2 is the protrusion amount of said first gate electrode's outward exposure, then L1 and L2 satisfy the relationship:

$$0.5 \leqq L2/L1 \leqq 2.0.$$

5. An electron emission device production method as claimed in claim 4, wherein after said second hole is formed, said first insulation layer, said second insulation layer, and said third insulation layer are subjected to isotropic etching, so that said first insulation layer is recessed outwardly further than said first gate electrode, and said second insulation layer and said third insulation layer are recessed further outwardly than said emitter electrode and said second gate electrode.

* * * * *